US009404263B2

(12) United States Patent
Kiik et al.

(10) Patent No.: US 9,404,263 B2
(45) Date of Patent: Aug. 2, 2016

(54) ROOFING MATERIAL AND METHOD OF MAKING THE SAME

(75) Inventors: Matti Kiik, Richardson, TX (US); Tommy F. Rodrigues, Nutley, NJ (US); Sudhir B. Railkar, Wayne, NJ (US); Adem Chich, Kearney, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 12/834,333

(22) Filed: Jul. 12, 2010

(65) Prior Publication Data

US 2011/0189433 A1 Aug. 4, 2011

Related U.S. Application Data

(60) Provisional application No. 61/299,664, filed on Jan. 29, 2010.

(51) Int. Cl.
*E04D 3/35* (2006.01)
*E04D 1/26* (2006.01)

(52) U.S. Cl.
CPC .. *E04D 3/35* (2013.01); *E04D 1/26* (2013.01); *Y10T 428/2438* (2015.01)

(58) Field of Classification Search
CPC ..... E04D 1/12; E04D 1/00; E04D 1/20; E04D 1/26; Y10T 428/24355; Y10T 428/243; Y10T 428/24372; Y10T 428/2438
USPC ..... 428/143
See application file for complete search history.

(56) References Cited

U.S. PATENT DOCUMENTS 2,099,131 A 11/1937 Miller
4,717,614 A * 1/1988 Bondoc et al. ..... 428/143

(Continued)

OTHER PUBLICATIONS

Wikipedia, "Shake (shingle)", available at http://en.wikipedia.org/wiki/Shake_(shingle) (last visited Apr. 18, 2013).

(Continued)

*Primary Examiner* — Nathan Van Sell
(74) *Attorney, Agent, or Firm* — Fitzpatrick, Cella, Harper & Scinto

(57) ABSTRACT

A roofing material comprising an upper surface and a lower surface, wherein the upper surface includes reduced-particle size granules and may further include a reduced-thickness face coating. The thickness of the upper surface is related to the particle size of the granules deposed on the face coating. A smaller particle size granule than those used in traditional roofing shingles is utilized in the upper surface which may allow for a reduced-thickness face coating while not sacrificing the retention of the granules on the surface of the roofing material or desired physical characteristics. The face coating may include a reduced amount of filler material, such as mineral fillers, than face coatings of traditional roofing materials.

12 Claims, 5 Drawing Sheets

(56) References Cited

U.S. PATENT DOCUMENTS

| | | | | |
|---|---|---|---|---|
| 5,571,596 | A | 11/1996 | Johnson | 428/143 |
| 5,611,186 | A | 3/1997 | Weaver | 52/557 |
| 6,145,265 | A | 11/2000 | Malarkey et al. | |
| 6,228,785 | B1 | 5/2001 | Miller et al. | 442/148 |
| 6,540,829 | B2 | 4/2003 | Allman et al. | 118/67 |
| 6,933,007 | B2 | 8/2005 | Fensel et al. | 427/186 |
| 2003/0152747 | A1 | 8/2003 | Fensel et al. | 428/143 |
| 2007/0044410 | A1* | 3/2007 | Kalkanoglu | 52/526 |
| 2007/0218250 | A1* | 9/2007 | Kiik | B32B 11/02 428/143 |
| 2007/0221095 | A1* | 9/2007 | Mehta et al. | 106/280 |
| 2008/0086970 | A1* | 4/2008 | Teng et al. | 52/518 |
| 2008/0160188 | A1* | 7/2008 | Teng et al. | 427/186 |
| 2008/0248242 | A1 | 10/2008 | Shiao et al. | 428/141 |
| 2010/0005745 | A1* | 1/2010 | Harrington, Jr. | E04D 1/20 52/409 |

OTHER PUBLICATIONS

The University of New England, "Using However," available at http://www.sonoma.edu/users/f/farahman/subpages/utilities/however.pdf (last visited Apr. 17, 2013).

* cited by examiner

ROOFING MATERIAL AND METHOD OF MAKING THE SAME

CROSS REFERENCE TO RELATED APPLICATIONS

This application claims priority under 35 U.S.C. §119(e) to Provisional Application No. 61/299,664, filed on Jan. 29, 2010.

FIELD OF THE INVENTION

The present invention relates to roofing materials that have optimized granule and face coating layers which render the roofing materials better for the environment, cost effective and lighter than traditional roofing products while providing excellent physical and mechanical properties, such as fire resistance, impact resistance, tear strength and water shedding, and to methods of making the roofing materials.

BACKGROUND OF INVENTION

Roofing material has an upper surface intended to be exposed to weather and a lower surface facing in the direction opposite to the upper surface. A typical asphalt shingle has an asphalt-based substrate with granules deposed thereon. The granules are embedded in a layer of asphalt on the upper surface of the substrate, referred to herein as the face coating. The face coating is of sufficient thickness to ensure that the granules are adequately retained on the surface of the shingle. The granules provide weather resistance, fire resistance and/or an aesthetic appearance. The aesthetic appearance may be achieved through pigmentation. Traditionally, No. 11 grade granules having a particle size of about 16-20 US mesh or about 47-33 mils are used in typical asphalt shingles. With increasing costs of petroleum based products, including asphaltic petroleum based products, it is desirable to reduce the asphalt component raw material cost. It is also desirable to reduce the amount of petroleum based products in roofing shingles for environmental purposes. It is further desirable to reduce the weight of roofing materials, for example, to reduce the cost associated with shipping the materials.

U.S. Pat. No. 6,933,007 is directed to roofing materials having increased reflectivity properties. The '007 patent discloses that the roofing materials have multiple coating layers, i.e, more than one layer, each of which has a different granule size, which are used to achieve the increased reflectivity. The '007 patent also discloses that the roofing materials include two granule coating layers with the first coating layer comprising No. 11 grade granules having an average particle size of about 19 US mesh and a second coating layer comprising granules having an average particle size of about 47 or 50 US mesh. In addition, the '007 patent discloses that the roofing materials include two granule coating layers with the first coating layer comprising No. 14 grade granules having an average particle size of about 22 US mesh and a second coating layer comprising granules having an average particle size of about 47 or 50 US mesh. Col. 16, lines 13-50.

Attempts to reduce the cost and/or weight of shingles have met with difficulty in achieving desired physical characteristics, and particularly desired impact resistance. To achieve the desired impact resistance, additional components have been used, such as reinforcing backings, including polypropylene (Capstone™ shingles), Kevlar fabric (U.S. Pat. No. 5,571,596) and web material (U.S. Pat. No. 6,228,785).

SUMMARY OF THE INVENTION

In accordance with the invention, roofing materials such as shingles are improved by increasing the granule coverage and thus achieving greater protection of the asphalt. Granule coverage is improved by reducing the particle size of the granules as compared with granules used in traditional roofing materials, which also may reduce the weight of the roofing materials. In addition, the reduced-particle size granules may allow for reducing the amount of the face coat used in the roofing materials. Reduced particle size granules also may result in reduced granule load on the shingle. In addition, less filler may be used in the face coat. The use of less face coat, e.g., asphaltic material, less filler and/or less granule load than traditional roofing materials makes the roofing materials of the invention more environmentally friendly and less costly to manufacture and ship, while still maintaining the desired specifications, and surprisingly maintaining excellent impact resistance.

The roofing material of the present invention may be any roofing material (e.g., roll roofing, single layer tab shingles, single layer dragon teeth shingles, and laminated shingles) and includes a substrate having a lengthwise dimension and a widthwise dimension that comprises a planar core material having an upper surface and a lower surface, wherein the upper surface includes a face coating having reduced-particle size granules deposed thereon, wherein the reduced particle size granules may also allow for a reduced-thickness face coating.

In one embodiment, the roofing material, which has reduced-particle size granules and may also have a reduced-thickness face coating, comprises a headlap and a butt section, with at least one of the headlap or butt section having at least two horizontal striations, wherein a first horizontal striation has granules of an average particle size and a second horizontal striation has granules of a different average particle size than the first horizontal striation. The different particle size of the striations creates a contrast between striations and may create a desired illusion of depth or thickness when the shingles are installed on a roof. The number of horizontal striations and their width may be varied to provide a greater illusion of depth or thickness. The color of the granules may also be varied to provide an enhanced visual appearance. In one embodiment, the roofing material is a single layer and the headlap section includes the at least two horizontal striations. In another embodiment, the roofing material is a laminated shingle including a backer strip, wherein the backer strip comprises the at least two horizontal striations.

BRIEF DESCRIPTION OF THE DRAWINGS

For a more complete understanding of the present invention and the advantages thereof, reference is made to the following descriptions, taken in conjunction with the accompanying drawings, in which.

DETAILED DESCRIPTION OF THE INVENTION

Figure 1:
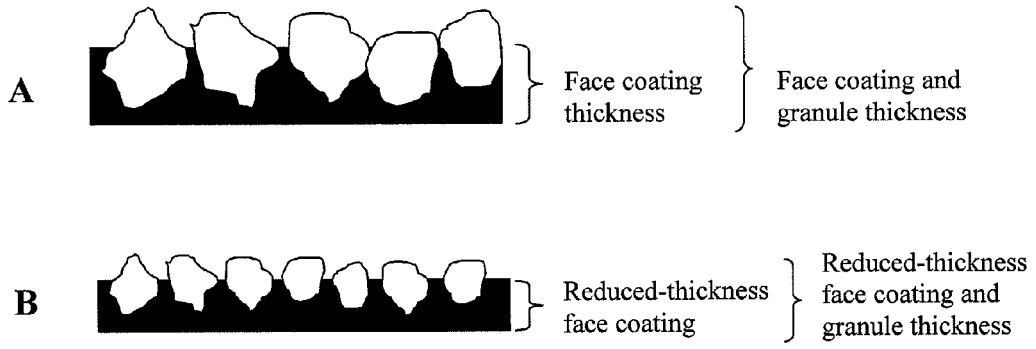
FIG. 1 is a side view comparing (A) a traditional roofing material upper surface having a traditional substantially uniform face coating thickness and traditional granules (e.g., Grade 11) deposed thereon, and (B) an exemplary roofing shingle's upper surface made in accordance with the present invention having a substantially uniform reduced-thickness face coating and reduced-particle size granules deposed thereon; the lower surfaces of the products (A) and (B) are not illustrated because each has a face coating having the substantially uniform thickness of traditional roofing materials.

Asphalt roofing materials, including roll roofing, single layer shingles and laminated shingles, have traditionally and extensively been manufactured by using as a base a fibrous web such as a sheet of roofing felt or fiberglass mat, impregnating the fibrous web with a bituminous material and coating one or both surfaces of the impregnated web with a weather-resistant bituminous coating material. The bituminous or asphaltic coating material usually contains a mineral filler such as slate flour or powdered limestone. Sometimes one or more fibrous sheets having one or more bituminous layers are laminated together to form a laminated roofing material. Usually there is applied to the bituminous/asphaltic coating on the surface intended to be exposed to the weather a suitable granular material such as slate granules or mineral surfacing. Finely divided materials such as mica flakes, talc, silica dust or the like may be adhered to the non-weather exposed surface of the roofing shingle to prevent sticking of the adjacent layers of the roofing material in packages.

In one embodiment of the present invention, the roofing material is roll roofing, single layer shingles or laminated shingles, and the upper surface of the roofing material is topped with granules having a reduced-particle size when compared with granules used in traditional roofing materials. The upper surface may further include a reduced-thickness face coating, e.g., an asphaltic face coating, on which the roofing granules are deposed. The thickness of the face coating may be related to the particle size of the granules deposed on the face coating. A smaller particle size granule allows for a correspondingly reduced-thickness face coating while not sacrificing granule retention. The face coating may be of sufficient thickness to accommodate at least 50% of the diameter of the largest granule in the distribution range to be embedded therein.

The face coating may be less than 30 mils thick; from about 10 mils to about 30 mils thick; from about 14 mils to about 25 mils thick; or about 14 mils thick.

The asphaltic face coating of the present invention preferably includes filler material, such as mineral fillers, including slate flour or limestone. The filler may comprises less than 75% of the face coating; from about 55% to about 75% of the face coating; from about 60% to about 68% of the face coating; or about 64% of the face coating. The use of less filler may also result in a reduction of weight.

Granules employed for roofing materials are generally derived from a hard mineral base rock, such as slate, basalt or nephelinite. These granules may be coated with pigment compositions to color the granules by heating them and applying a paint slurry to them. Some common pigments include red iron oxide, yellow iron oxide, titanium dioxide, chrome hydrate, chrome oxide, chrome green, ultramine blue, phthalocyanine blue and green, carbon black, metal ferrites, and mixtures thereof.

The roofing materials of the invention include granules embedded in the face coating which have a reduced particle size when compared with granules in traditional roofing materials and may have an average particle size of less than 35 mils; from about 17 mils to about 35 mils; from about 23 mils to about 33 mils; or about 23 mils.

Figure 2:
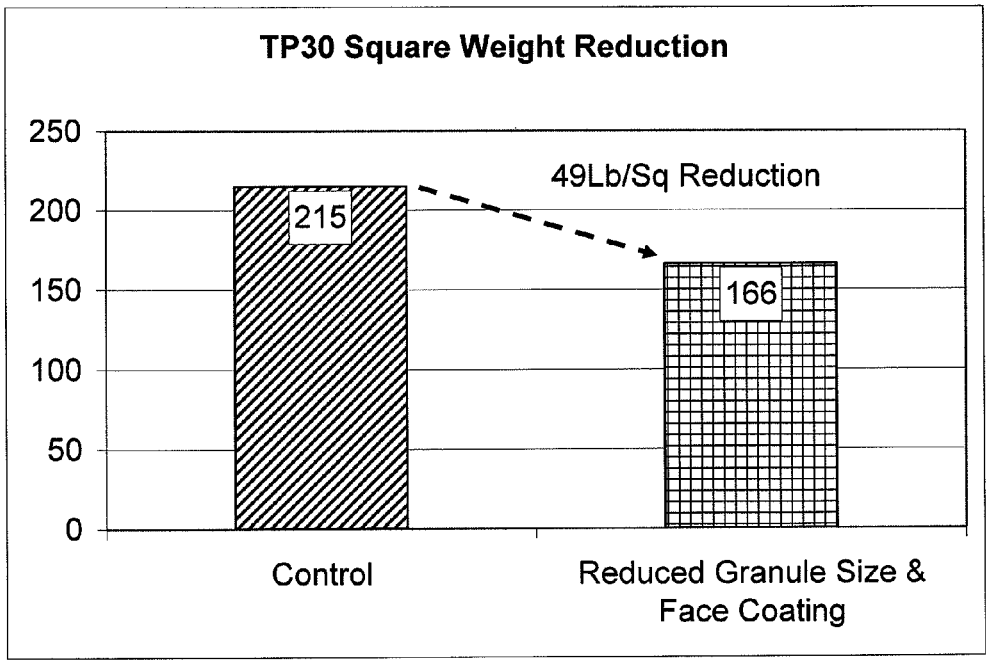
FIG. 2 is a graph showing the weight reduction achieved with an exemplary roofing shingle made in accordance with the present invention.

As illustrated in FIG. 1, when reduced-particle size granules are used in accordance with the invention, the thickness of the face coating may be correspondingly reduced without sacrificing the retention of the roofing granules. In one embodiment, approximately 94% of the granules are retained on the surface after exposure to abrasion. This may be tested, for example, using a standard ASTM D4977 test. As illustrated in FIG. 2, the use of a reduced-thickness face coating and reduced-particle size granules may reduce the weight of a shingle made in accordance with the present invention by approximately 20%. In other embodiments of the invention, weight reductions from about 8% to about 20% may be expected.

Embodiments of the present invention include single layer shingles or laminated shingles having a plurality of dragon teeth with openings therebetween. For the laminated shingle, a backer strip is provided under the dragon teeth, with portions of the backer strip exposed through the openings between the dragon teeth. In a single layer shingle, when the shingle is installed on a roof deck, the dragon teeth of a second layer of shingles is placed on the headlap of a previously installed layer of shingles, such that portions of the headlap region are exposed through the openings between the dragon teeth. Each dragon tooth preferably has a relatively uniform value and/or color. The color and value of adjacent dragon teeth may vary as desired. The exposed portions of the backer strip and/or headlap preferably have a value gradation from light to dark to create a desired illusion of depth and/or thickness which is created, in part, by the use of at least two horizontal striations, wherein a first horizontal striation has granules of one average particle size and a second horizontal striation has granules of a different average particle size.

Figure 3:
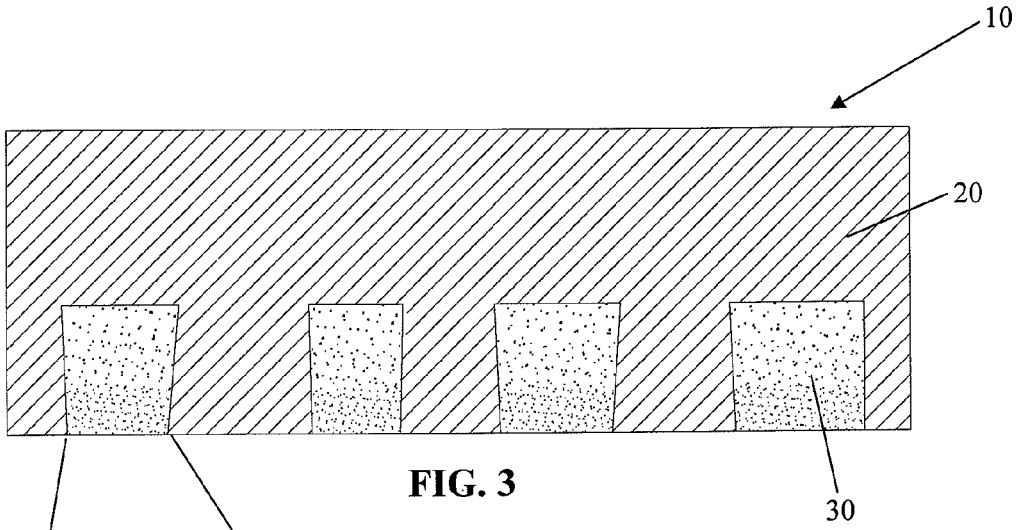
FIG. 3 is a top view of an exemplary roofing shingle made in accordance with the present invention having three horizontal striations, each having granules of different average particle size.
Figure 4:
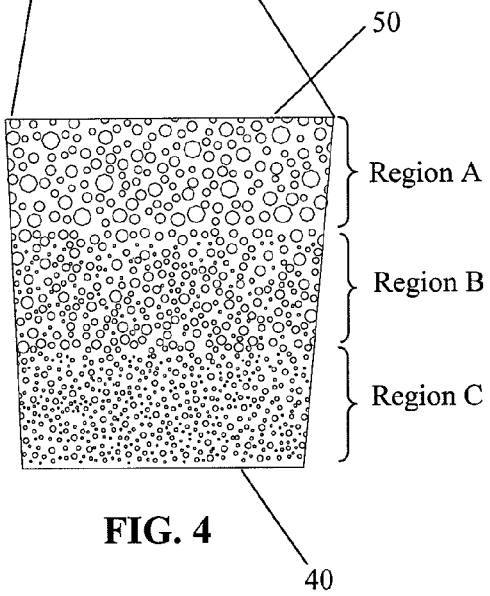
FIG. 4 is an exploded view of the three horizontal striations "A," "B" and "C" of FIG. 3.
Figure 5:
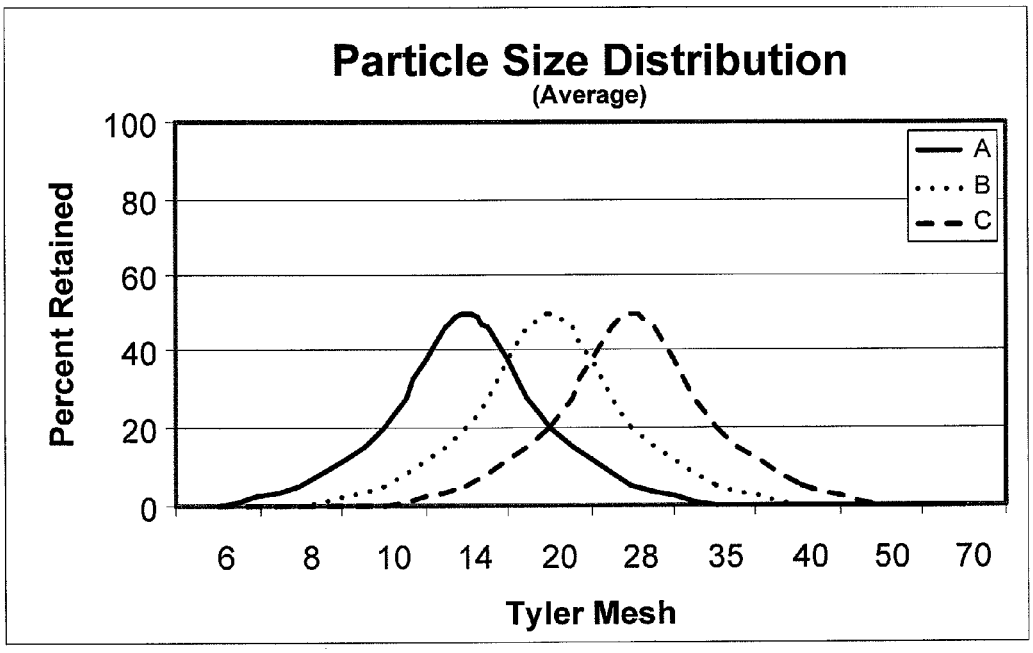
FIG. 5 is a graph showing the average particle size of each of the horizontal striations (A, B and C) of FIG. 4.

FIG. 3 shows a laminated shingle 10 in accordance with the invention having a dragon teeth layer 20 and a backer strip layer 30, wherein the backer strip layer 30 includes three horizontal striations, each of which includes granules having an average particle size that differs from the adjacent horizontal striation. As noted above, where the shingle is a single layer shingle, these horizontal striations are on the headlap section of the shingle. FIG. 4 is an exploded view of a region of the backer strip having three horizontal striations, A, B and C, each of which has granules of a different average particle size. FIG. 5 shows the average particle size of the granules of each of the horizontal striations A, B and C.

The average particle size of a first striation may be from about 25 mils to about 100 mils, or about 45 mils and the average particle size of a second striation may be from about 20 mils to about 70 mils, or about 35 mils. A third striation may be included which may have granules with an average particle size of from about 15 mils to about 45 mils, or about 25 mils. It is preferred that the horizontal striations are provided with the striation at the leading edge of the headlap or backer strip 40 having the smallest average particle size and the striation at the trailing edge of the headlap or backer strip 50 having the largest average particle size. Each striation may also have a different or the same color value.

The roofing materials made in accordance with the present invention have excellent tear strength, water shedding, wind resistance, UV protection, fire resistance and pliability properties, as further demonstrated below in the examples. In addition, and surprisingly, the shingles have excellent impact resistance properties, while being lighter weight, more economical and better for the environment. The use of reduced-particle size granules reduces the overall thickness of the roofing materials of the invention which allows for more materials to be packaged in a bundle or pallet. In addition, the roofing materials of the invention demonstrate reduced distortion when stored as packaged. The reduced thickness and weight may reduce material transportation and warehousing costs and may result in a smaller carbon footprint, thus helping the environment.

EXAMPLE 1

A fiberglass mat of about 1.63 lbs/csf was placed on a jumbo roll having a width corresponding to the width of the mat. The shingles were made in a continuous process where the glass mat was coated on the upper surface and lower surface with asphalt comprising a limestone filler. Fines were provided on the lower surface to seal the asphalt coating.

Table I below compares the weight of the face coat and granule layers for a control shingle and inventive shingle in accordance with the invention. For the inventive shingle, the thickness of the asphalt coating applied to the upper surface, i.e., the face coating, was 14 mils and had a weight of 12 lbs/csf. Grade 18 granules (IPS Mineral Products) having an average particle size of 23 mils were deposed on the face coating in a continuous process. A control shingle was also prepared in which the thickness of the face coating was 20 mils and had a weight of 17.5 lbs/csf. Grade 11 granules having an average particle size of 47 mils were deposed on the face coating. The shingles made in accordance with the invention had a square weight of 166 lbs/square, whereas the control shingles had a square weight of 215 lbs/square.

TABLE I

| | Lbs/CSF | Lbs/SQ |
|---|---|---|
| Control Shingle | | |
| Butt Granule | 11.76 | 34.81 |
| Headlap Granule | 16.24 | 48.07 |
| Face Coating | 17.5 | 51.80 |
| Inventive Shingle | | |
| Butt Granule | 7.14 | 21.13 |
| Headlap Granule | 9.86 | 29.19 |
| Face Coating | 12.00 | 35.52 |

The results depicted below in Table II for the shingle made in accordance with the present invention indicate that the shingle manifests excellent physical and mechanical properties.

TABLE II

| Property Tested | Min | Max | Inventive Shingle | Status |
|---|---|---|---|---|
| Asphalt, lbs/100 $ft^2$ ($g/m^2$) | 15.0 (732) | — | 24.0 (1171) | Pass |
| Mat, lbs/100 $ft^2$ ($g/m^2$) | .135 (65.9) | — | 2.58 (126.2) | Pass |
| Course mineral matter, lbs/100 $ft^2$ ($g/m^2$) | 25.0 (1221) | — | 34.7 (1692) | Pass |
| % Fine mineral matter | 70.0% | — | 51.7% | Pass |
| Average Net Mass per Area of Shingles, lbs/100 $ft^2$ ($g/m^2$) | 73.0 (3564 | — | 74. (3616) | Pass |
| % Loss of volatile matter | — | 1.5% | 0.20% | Pass |
| Sliding of granular surfacing, inc. (mm) | — | 1/16 (2) | 0 | Pass |
| Tear Strength, g | 1700 | — | 1878 | Pass |
| Fire resistance | Class A | — | Class A | Pass |
| Pliability at 73° F. | — | — | 100% Pass | Pass |
| Weight of displaced granules, g | — | 1.0 | 0.29 | Pass |
| Fastener pull-through resistance at 73° F., lbf (newtons) | 30 (135) | — | 61 (272) | Pass |
| Fastener pull-through resistance at 32° F., lbf (newtons) | 40 (180) | — | 46 (203) | Pass |

Figure 6:
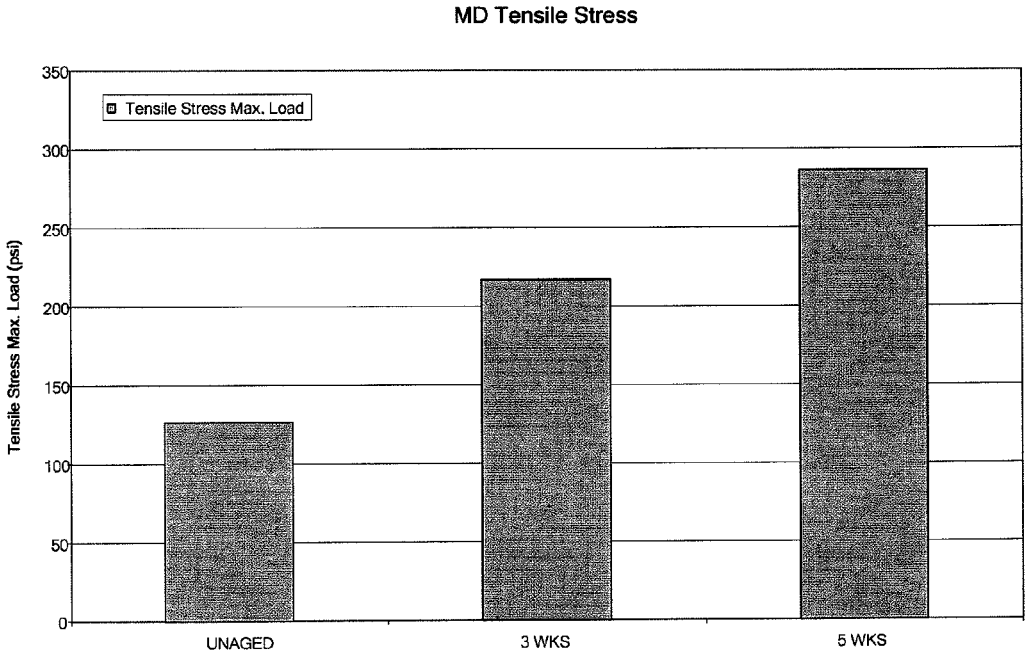
FIG. 6 is a graph showing the results from an aged tensile stress test of an exemplary roofing shingle made in accordance with the present invention.

The inventive shingle of the invention was also tested for aged tensile strength and aged tensile stress properties. The results of these tests are provided below in Table III and in FIG. 6, respectively, and show that exposure to a hot humid environment did not significantly adversely affect the tensile strength and tensile stress properties of the present invention.

TABLE III

| Aged Tensile Strength | |
|---|---|
| Hot Humid Oven Aged | MD Tensile Strength |
| Unaged | 523 |
| 3 weeks hot humid oven | 498 |
| 5 weeks hot humid oven | 516 |

EXAMPLE 2

Two granule size distributions (version #1 and version #2) used to prepare the shingles of the present invention were compared with a control granule size distribution (control butt granules) used in conventional roofing shingles. At least 100 squares of both laminated and single layer strip shingles were manufactured using each of the granule size distributions by conventional shingle manufacturing processes. Each shingle was manufactured using the same coating weight or composition to demonstrate the affect of each granule distribution on the physical characteristics of the shingle. The control laminated shingles and the control strip shingles were manufactured by standard techniques using the butt granule size distributions.

Table IV indicates the retained percentage of granules for each sieve. Table V indicates the bulk density and specific gravity for each granule size distribution.

TABLE IV

| Sieves US mesh (mils) | Sieve Opening | Control Butt Granules | Version #1 Granules | Version #2 Granules |
|---|---|---|---|---|
| 12 (66) | 1.7 | 7.0% | 0% | 0% |
| 16 (47) | 1.0 | 37.4% | 2.8% | 0% |
| 20 (33) | 0.9 | 30.0% | 40.9% | 36% |
| 30 (23) | 0.6 | 19.1% | 41% | 41.3% |
| 40 (17) | 0.4 | 6.1% | 14.2% | 21.3% |
| Pan | 0.0 | 0.4% | 1.1% | 1.4% |

TABLE V

| | Control Granules (Butt) | Version #1 Granules | Version #2 Granules |
|---|---|---|---|
| Bulk Density | 90.6 lb/ft$^3$ | 81.5 lb/ft$^3$ | 81.4 lb/ft$^3$ |
| Specific Gravity | 2.9 | 2.72 | 2.70 |

The inventive laminated shingles having version #1 and version #2 granule size distributions, and the inventive strip shingles having version #2 granule size distributions resulted in significant improvements over conventional laminated and strip shingles prepared with the control distributions while still maintaining desired specifications. Table VI lists the finished product specifications for each granule size distribution. The inventive versions #1 and #2 laminated shingles had pallet weight reductions over the control laminated shingles of 300 lbs and 355 lbs, respectively. The inventive version #2 strip shingles had a pallet weight reduction over the control strip shingles of 223 lbs. Also, the pallet heights of the inventive versions #1 and #2 laminated shingles and inventive version #2 strip shingles were significantly smaller than the pallet height of the control shingles, with an overall reduction close to 3 inches for the laminated shingles and an overall reduction of 3.5 inches for the strip shingles.

TABLE VI

| | Control Laminated Shingles | Control Strip Shingles | Version #1 Laminated Shingles | Version #2 Laminated Shingles | Version #2 Strip Shingles |
|---|---|---|---|---|---|
| Square Weight Reduction, lbs | 0 | 0 | −18 | −22 | −14.9 |
| Face Coating, mils | 20.9 | 24.4 | 20.6 | 21.5 | 24.4 |
| Pallet Height, inches | 35 | 35 | 32 1/16 | 32 1/16 | 31.5 |
| Pallet Weight, lbs | 3,400 | 2,750 | 3,100 | 3,045 | 2,527 |

The inventive versions #1 and #2 laminated and inventive version #2 strip shingles were run through tear, class 4 impact resistance, and where indicated, rub loss tests. Version #1 laminated shingles had a tear strength of 1,918 g and a rubloss of 0.15 g, version #2 laminated shingles had a tear strength of 2,038 g and a rubloss of 0.36 g, and version #2 strip shingles had a tear strength of 1,688 g. The control laminated shingles had a tear strength of 1,952 g and a rubloss of approximately 0.5 g. The control strip shingles had a tear strength of 1,820 g.

Additionally, the inventive versions #1 and #2 laminated shingles and the inventive version #2 strip shingles were run through class 4 impact tests. In class 4 impact tests, a 2" diameter steal ball is dropped on the edge or corner of a test shingle and then the shingle is bent 180 degrees. If a visual crack is observed in the shingle, then the shingle fails class 4 impact testing. Each of the inventive laminated and strip shingles passed class 4 impact testing without requiring a special backing. Passing class 4 impact testing was an unexpected discovery. Heretofore, when roofing shingles were manufactured with a reduced weight and/or reduced materials, those shingles were unable to pass class 4 impact testing unless reinforcing materials were included.

Table VII provides additional product quality testing results based on the ASTM D3462 standard for the inventive versions #1 and #2 shingles and the control shingles when applied in rows on a roof deck.

TABLE VII

| | Min | Max | Control Laminated Shingles | Version #1 Laminated Shingles | Version #2 Laminated Shingles | Control Strip Shingles | Version #2 Strip Shingles |
|---|---|---|---|---|---|---|---|
| Loss of volatile matter, % | — | 1.5 | 0.0 | 0.1 | — | — | — |
| Sliding of granular surfacing, mm | — | 2.0 | 0.2 | 0.1 | — | — | — |
| Tear Strength g | 1,700 | — | 1,952 | 1,918 | 2,038 | 1,820 | 1,688[1] |
| Fastener pull-through resistance at 23 C, lbf | 30 | — | 50 | 46 | — | 22.3 | 19.8 |
| Fastener pull-through resistance at 0 C, lbf | 40 | — | 60 | 54 | — | — | — |
| Wind resistance | Class A | — | Class F | Pass | Fail[2] | Class F | — |
| Fire resistance | Class A | — | Class A | Class A | Class A | Class A | — |
| Pliability at 23 C | Pass | — | Pass | Pass | — | Pass | Pass |
| Weight of displaced granules, g | — | 1 | 0.55 | 0.29 | 0.51 | 0.6 | 0.41 |
| Average net mass per area of shingles, lbs/csf | 48.7 | — | 70.5 | 64.4 | 63.1 | 77.6 | 71.2 |
| Mass per area of asphalt, lbs/csf | 10.0 | — | 12.8 | 13.0 | 13.0 | 15.5 | 15.2 |
| Mass per area of coarse mineral matter, lbs/csf | 16.7 | — | 28.5 | 26.1 | — | >25.0 | 25.0 |
| Mass percent of fine mineral matter, % | — | 70.0 | 63.9 | 63.0 | — | 64.0 | 64.0 |

[1]The tear strength is within an acceptable range

[2]The wind resistance test failed due to the use of insufficient adhesive.

It should be understood that the above embodiments are illustrative, and other embodiments other than those described herein can be employed while utilizing the principles underlying the present invention.

What is claimed is:

1. An unproved roofing material comprising an upper surface and a lower surface, wherein the upper surface comprises:

an upper face coating comprising asphalt and having a thickness of from about 14 mils to about 25 mils throughout said upper surface; and one layer of granules deposed on the upper face coating having an average particle size from about 23 mils to about 33 mils, and wherein the lower surface is a traditional lower surface without a reinforcing backing comprising a lower face coating comprising asphalt and finely divided materials adhered thereto, and wherein said lower face coating is substantially planar and has a substantially uniform thickness throughout said lower surface.

2. The roofing material according to claim 1, wherein the upper face coating further comprises a filler material.

3. The rooting material according to claim 2, wherein the filler material comprises about 55% to about 75% of the upper face coating.

4. The roofing material according to claim 2, wherein the filler material comprises about 60% to about 68% of the upper face coating.

5. The roofing material according to claim 2, wherein the filler material comprises about 64% of the upper face coating.

6. The roofing material according to claim 1, wherein the upper face coating is an asphaltic face coating.

7. The roofing material according to claim 1, wherein the upper the coating thickness is about 14 mils.

8. The roofing material according to claim 1, wherein the granules have an average particle size of 23 mils.

9. The rooting material according to claim 1, wherein the roofing material is selected from the group consisting of roll roofing, laminated shingles, and single layer shingles.

10. An improved roof material comprising an upper surface and a lower surface, wherein the upper surface comprises:

an upper the coating comprising asphalt and having a thickness of from about 14 mils to about 25 mils throughout said upper surface; and one layer of granules deposed on the upper face coating having an average particle size from about 23 mils to about 33 mils; and wherein the lower surface is a traditional lower surface without a reinforcing backing comprising a lower face coating comprising asphalt and finely divided materials adhered thereto, and wherein said lower face coating is substantially planar and has a substantially uniform thickness throughout said lower surface; and wherein weight of the roofing material is reduced by at least about 8% to about 20% compared with a weight of a control roofing material made using standard manufacturing processes and granules of a standard size.

11. The roofing material according to claim 10, wherein the weight of the roofing material is reduced by about 20% compared with the weight of the control rooting material.

12. The rooting material according to claim 10, wherein the weight of the roofing material is about 166 pounds/square.

* * * * *